United States Patent [19]

Stephens

[11] 4,326,324

[45] Apr. 27, 1982

[54] MANUFACTURE OF ELECTRIC LIGHT SOURCES

[75] Inventor: Stanley W. Stephens, Lightwater, England

[73] Assignee: Badalex Limited, England

[21] Appl. No.: 141,598

[22] Filed: Apr. 18, 1980

Related U.S. Application Data

[63] Continuation of Ser. No. 965,051, Nov. 30, 1978, abandoned.

[30] Foreign Application Priority Data

Dec. 22, 1977 [GB] United Kingdom ..... 53522/77

[51] Int. Cl.[3] ..... H01J 9/00

[52] U.S. Cl. ..... 29/25.19

[58] Field of Search ..... 29/25.19, 25.2; 316/27, 316/30; 414/680

[56] References Cited

U.S. PATENT DOCUMENTS

| | | | |
|---|---|---|---|
| 2,575,746 | 11/1951 | Cartun | 65/153 |
| 2,721,422 | 10/1955 | Baker et al. | 49/2 |
| 3,113,011 | 12/1963 | Gilbert, Jr. et al. | 65/138 |
| 3,399,044 | 8/1968 | Kolkman et al. | 65/155 |
| 3,399,045 | 8/1968 | Reynders et al. | 65/155 |
| 3,667,632 | 6/1972 | Tidswell | 414/680 |

FOREIGN PATENT DOCUMENTS 47-4915418 4/1974 Japan .

*Primary Examiner*—Joseph H. McGlynn

*Attorney, Agent, or Firm*—Kerkam, Stowell, Kondracki & Clarke

[57] ABSTRACT

In apparatus for and a method of sealing mounts to fluorescent lamp tubes on horizontal sealing machines each sealing head has a mount holding member pivotable between a mount sealing position in which it is coaxial with the lamp tube and a mount loading position which is angularly displaced by about 90° in a plane normal to the direction of travel of the sealing heads from the mount sealing position and in which it can accept mounts from a mount conveyor externally of the sealing machine.

4 Claims, 3 Drawing Figures

MANUFACTURE OF ELECTRIC LIGHT SOURCES

This is a Continuation of Application Ser. No. 965,051 filed Nov. 30, 1978, and now abandoned.

BACKGROUND OF THE INVENTION

1. Field of the Invention

The present invention relates to an improved apparatus and method for making electric light sources, particularly tubular fluorescent lamps. Although the invention is of general applicability, it may be usefully combined with the invention described and claimed in U.S. Ser. No. 865,576 filed on Dec. 29, 1977 by J. P. Crenfell and S. W. Stephens.

The structure of conventional fluorescent lamps is well-known. They are generally made on high speed automatic machine groups which inter alia include stem making machines, mount mills for making mount assemblies from the stems and cathodes with their lead-in wires sealed in place, conveyors for passing the assembled mounts to a sealing machine which also receives hollow lamp tube envelopes via a further conveyor from an oven known as a "lehr" where the phosphor is baked on the inner wall of the tubes at an elevated temperature.

2. Description of the Prior Art

Known lamp sealing machines can be classified into two broad groups, namely the so-called vertical machines and horizontal machines. In a vertical machine sealing of the mounts to the ends of the lamp tube is effected sequentially: first, with the tube held vertically, a mount is sealed to the lower end of the lamp tube, the lamp tube is then removed from the sealing machine, inverted through 180°, reinserted in the machine and finally the second lamp mount is sealed to the other end thereof. In horizontal machines the lamp tube is held substantially horizontally and the two mounts are sealed to the ends of the lamp tube substantially simultaneously.

In addition to the broad classification into vertical and horizontal machines, the machines can also be distinguished as to their mode of operation, namely indexing or intermittent, and continuously operated machines. A further distinction arises with regard to the means employed to advance the heads in which the lamp tube and sealing burners are supported. Thus, the heads may be supported by a pair of spaced endless chain conveyors or by a pair of spaced apart rotary turrets rotating about a horizontal axis.

The present invention is applicable to all types of horizontal sealing machines with mount assemblies, "mount loading" but is most useful for high-speed, continuous, rotary turret sealing machines.

It will be obvious that the overall rate of output of an automatic fluorescent tube making machine group is closely bound up with the rate and efficiency of mount loading. While it is theoretically possible to increase the rate of delivery of mount assemblies from the mount mills to the sealing machine and to increase the number of heads and/or the rate of rotation of the sealing machine turrets, the chief problem arises at the stage of transferring the mount assembly from the conveyor and loading it into the sealing head. Essentially in all known commercially operating high speed machines the mounts must be introduced into a head of the sealing machine from the interior of the machine, i.e. from within the cylindrical space defined by the two turrets as end faces and the mantle surface which is covered by the tubular lamp envelopes that extend between the heads disposed around the turrets. Bearing in mind that the gap between circumferentially adjacent tube envelopes is desirably small in order to maximise the number of heads of the sealing machine, and bearing also in mind that the turrets rotate at a relatively high speed, the transfer of mounts from the mount conveyor heads can only be effected by introducing the mounts into the interior of the sealing machine from the conveyor heads to the sealing heads in a synchronized manner by "wasting" heads, that is to say, by leaving some heads not loaded with tubes until the turrets have rotated clear of the mount loading mechanism. Known constructions with this purpose are extremely intricate, see for example U.S. Pat. Nos. 2,721,422 Baker et al; 3,113,011—Gilbert et al, and 3,399,044—Kolkman et al. These known mechanisms all involve a plurality of mount conveyors, transfer mechanisms, associated cams and other controls.

SUMMARY OF THE PRESENT INVENTION

The present invention seeks to overcome or at least to mitigate, the above-mentioned disadvantages, to simplify mount loading and to enable it to be carried out more reliably and more rapidly.

According therefore to one aspect of the present invention, there is provided a sealing head for a horizontal sealing machine of the type including at least one pair of sealing heads each of which is arranged to receive a mount assembly to be sealed to the respective ends of a tubular lamp envelope that extends between the heads, said sealing head including a head frame, and a mount holding member directly or indirectly secured to said head frame by means of a connection that permits the mount holding member to be angularly displaced between a mount sealing position in which the mount and tube are coaxially aligned and a mount loading position sufficiently angularly spaced from the said mount sealing position to allow a mount to be introduced into and held by the mount holding member.

Preferably, the angular displacement of the mount holding member between the mount loading and sealing positions is about 90° in a direction normal to the direction of travel of the heads (in a generally vertical plane for a rotary turret machine).

Preferably the connection between the head frame and the mount holding member is an articulated connection. The mount holding member may be axially slidably reciprocable on a slide bed connected by a pair of pivot bolts to an arm connected in turn to the said frame.

Preferably, in a rotary turret machine the mount holding member is pivoted from the mount sealing position to a generally vertical mount loading position and back to the mount sealing position within a relatively narrow angular range of turret rotation, centred on the "bottom dead centre" of the sealing head in question on the rotary turret.

The mount holding member preferably carries the usual sealing burners, but this need not be so: the sealing burners may be mounted on a separate ring.

According to another aspect of the invention, there is provided a method of sealing mounts to the ends of a fluorescent lamp tube in a horizontal sealing machine that includes at least one pair of sealing heads between which a lamp tube extends, the method comprising connecting a mounting holding member to the frame of the heads so that the mount holding member is angularly displaceably between a mount sealing position in which it is coaxial with the lamp tube and a mount loading position sufficiently angularly spaced from the side mount sealing position to allow a mount to be introduced into and held by the mount holding member, feeding mounts to a location externally of the sealing machine and aligned with the mount loading position of the mount holding member, causing relative movement between a mount and the mount holding member to effect capture of the mount by the mount holding member and angularly displacing the mount holding member from the mount loading position to the mount sealing position to effect sealing of the mount to the lamp tube.

When in the preferred embodiment the mount holding member is in a vertical or substantially vertical position, the mount can be loaded into it externally (and not, as in the prior art, internally) of the turret machine, in a vertically downward direction, thereby avoiding the complications discussed above.

In contrast to the prior art, the mount loading conveyor will then essentially operate in an ideal mount loading attitude, i.e. will rotate in a horizontal plane about a vertical axis, and when the mount conveyor heads reach the vertical plane in which the pivoted-down head axially slides, mount capture and transfer can be effected, with gravity assistance if required, much more easily than in prior art mechanisms.

BRIEF DESCRIPTION OF THE DRAWINGS

The invention will now be described, merely by way of example, with reference to the accompanying purely diagrammatic drawings, in which.

DESCRIPTION OF THE PREFERRED EMBODIMENT

The drawings show a fragmentary detail of a horizontal rotary turret sealing machine of a fluorescent tube making machine group.

Figure 3:
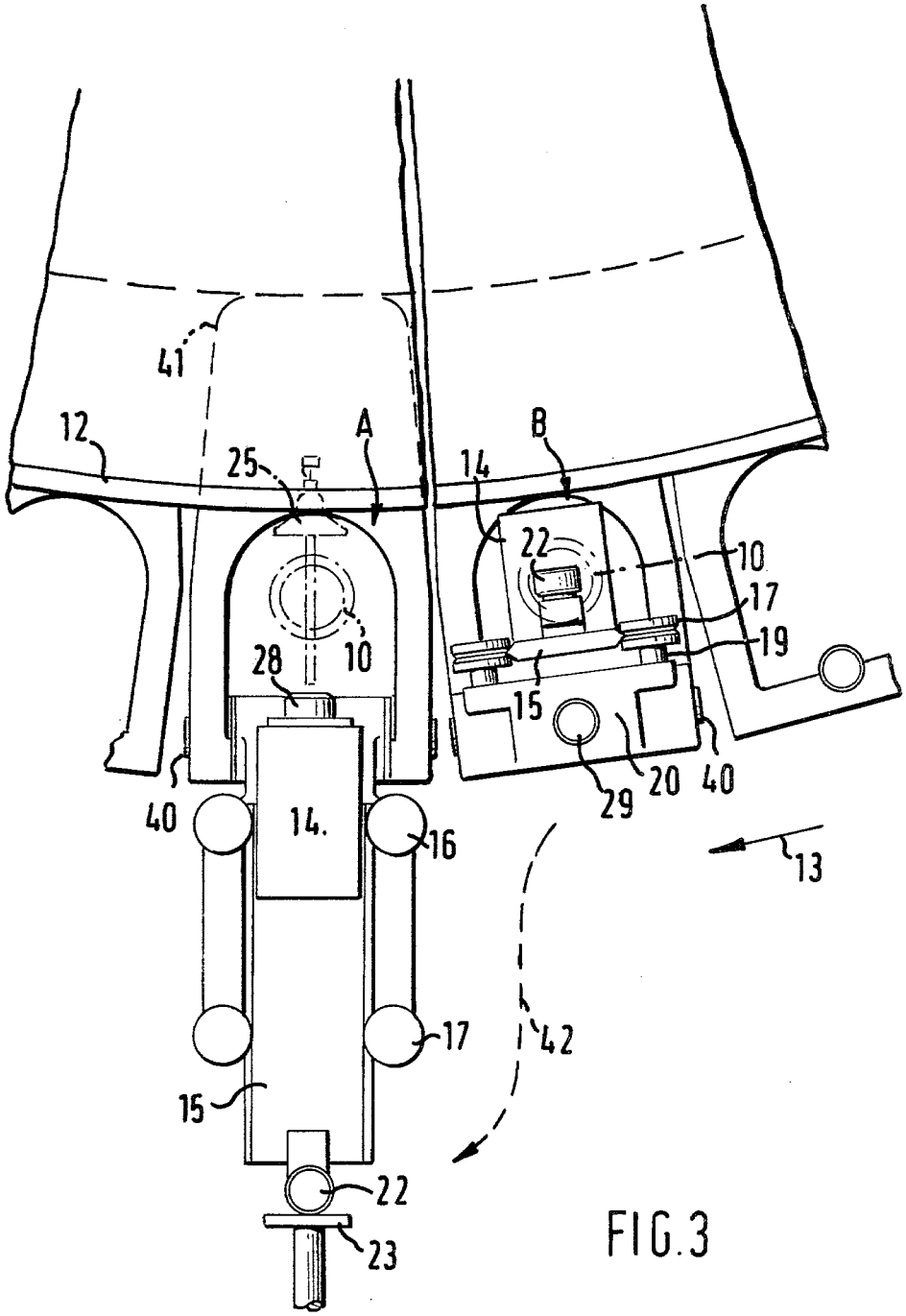
FIG. 3 is an end view of the head at two positions designated A and B, wherein position A is a view taken along the arrow X in FIG. 2, while position B is the corresponding view of the FIG. 1 position of the head.

There is shown one end of a tubular fluorescent lamp envelope 10 held in suitable holders (not shown) secured to a portion of the main frame 12 of the turrets rotatable in the direction of arrow 13 in FIG. 3. The Figures show a mount holding member incorporated into a sealing head 14 of a very large number of similar sealing heads 14 spaced around each turret. The heads 14 may be of generally known construction (and hence not further described in detail herein); or, the heads and/or turrets may be of the type described in the aforementioned Patent Application.

Figure 1:
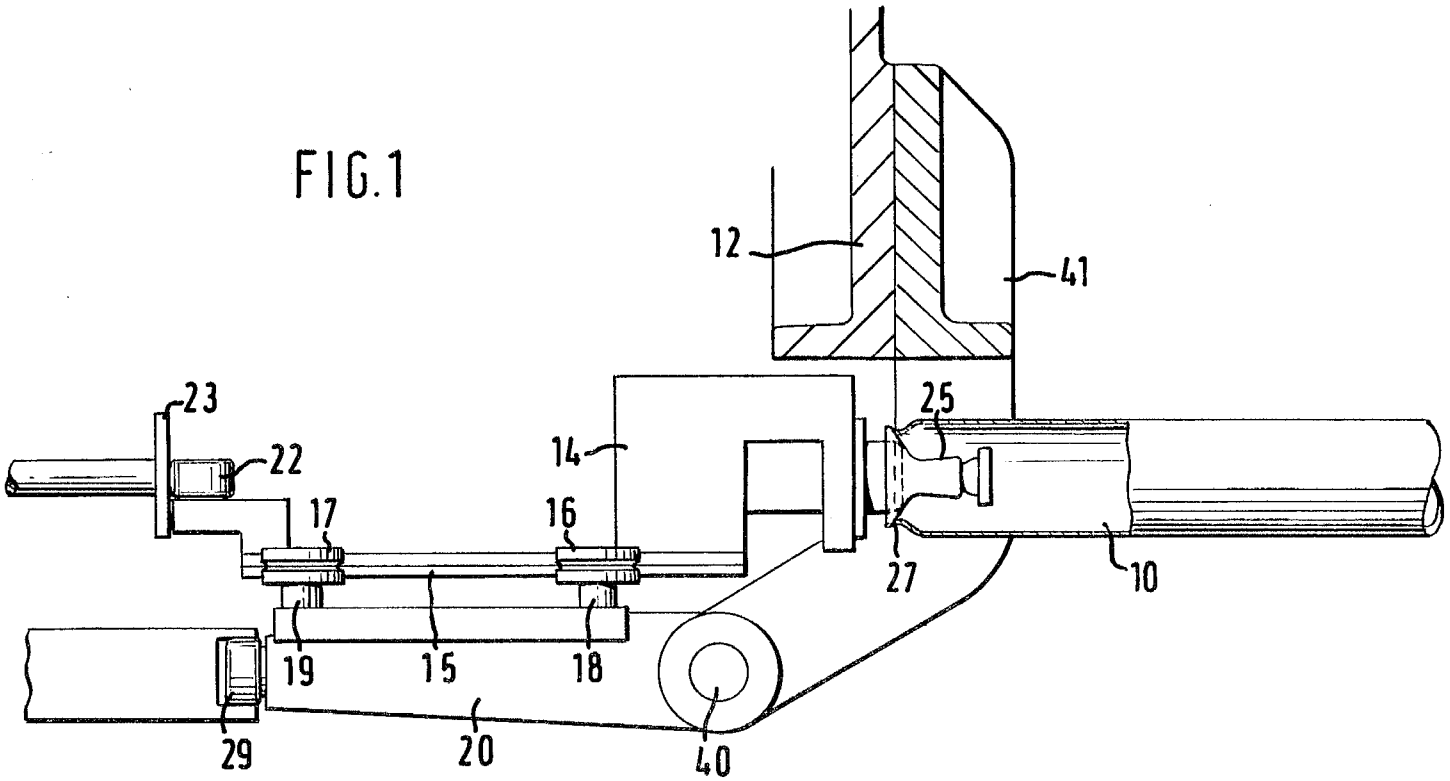
FIG. 1 and FIG. 2 are part-sectional elevations of a preferred embodiment of the invention showing a sealing head on a horizontal turret machine respectively in the mount sealing position of the head and in its mount loading position.
Figure 2:
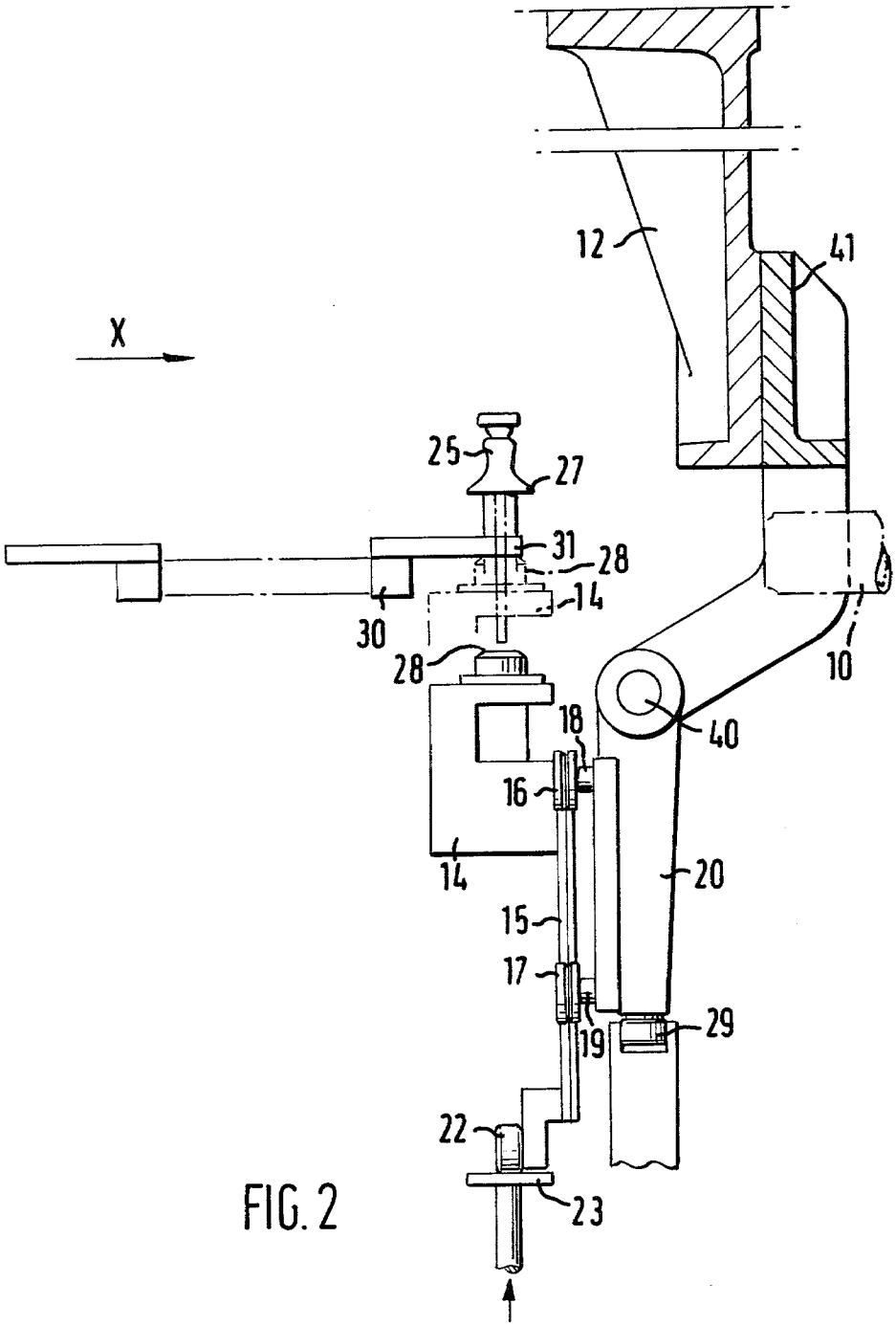

The head 14 is mounted for axial reciprocating sliding movement on a slide 15. Its sliding movement is guided by rollers 16, 17 connected by respective spindles 18, 19 to a main casting 20 pivotally secured, as will be described to the main turret frame 12. An additional roller 22 at the rear of the slide 15 is arranged to roll on a track 23 which is movable up and down as seen in FIGS. 2 and 3 to advance or retract the head 14. This reciprocation of the head 14 is in order to advance a mount 25 held therein until the flare 27 of the mount 25 comes into abutting engagement with the end of the tube 10 allowing a burner 28 to seal the flare 27 and the tube end together. More generally, non-illustrated cam means are provided for each head 14 to perform reciprocating axial movements in accordance with the usual working cycle of pre-heating the tube end butting the seal by means of a butting board (not shown), annealing the seal at a lower temperature, seal stretching and the like.

In FIG. 2 the head 14 is at substantially the bottom dead centre position of the annular turret 12 and has been displaced by a suitable cam mechanism, only schematically indicated at 29, from a generally horizontal position to a generally vertical position. It will be appreciated that in this vertical position, when the head 14 is moved axially upwardly as shown in chain lines, it is a relatively simple matter to introduce into the head 14 a mount 25 held in a head 30 of a mount loading conveyor 31 in the same vertical plane and externally of the sealing machine itself, in contrast with the known, intricate, internal loading arrangements described above. Once the head 14 has been loaded it is then pivoted back into its horizontal position to effect sealing.

The construction permitting the 90° angular movement of the head between its generally horizontal and generally vertical positions is essentially a simple articulated connection in which the bed or main casting 20 of the slidable head 14 is connected by a pivot 40 to an arm 41 of the head frame.

Although in the preferred embodiment mount loading takes place at "bottom dead centre" after an angular displacement of the head 14 of 90° in a vertical plane (disregarding the fact that as the turrets rotate the actual movement of the heads 14 is more complex, as sought to be indicated by the broken arrow 42 in FIG. 3), alternative embodiments are conceivable. Thus mount loading may take place at "top dead centre" with upward movement of the mounts from the mount conveyor heads; or indeed mount loading may take place at intermediate positions and with the heads 14 pivoting over angles other than 90°. Angular displacement mechanisms more complex than or different from simple pivots may be used. Instead of rotary turrets, chain conveyors may be employed to advance the heads an in either case head movement may be continuous or intermittent.

I claim as my invention:

1. A sealing head for a rotary turret sealing machine for sealing mounts to the ends of fluorescent lamp tubes of the type having a horizontal axis of rotation;

said sealing head being one of at least one pair of such sealing heads each of which is arranged to receive a mount assembly that includes an exhaust tubulation and which heads serve for simultaneously sealing a said mount assembly to the respective ends of a tubular lamp envelope that extends between the heads;

said sealing head including a head frame forming part of a rotary turret and a mount holding member secured to said head frame for rotation therewith by means of a connection that permits the mount holding member to be angularly displaced relative to the head frame during rotation thereof, the angular displacement being about an axis extending at 90° to the said horizontal axis, and in a direction away from the other sealing head of said pair; and means for effecting said angular displacement of said mount holding member about said connection relative to the head frame, between a mount sealing position in which a mount assembly held in said mount holding member is oriented with the axis of said tubulation parallel and non-coplanar with the said horizontal axis of rotation.

2. A sealing head according to claim 1 wherein the mount holding member carries sealing burners for sealing the mounts to the tube ends.

3. A sealing head according to claim 1 wherein a slide bed is connected to the mount holding member, a mount holding portion of the sealing head is axially slidably reciprocable on said slide bed, a head bracket is connected to the said head frame, and pivot means connecting the slide bed and the head bracket.

4. A sealing head according to claim 3 wherein means are provided to limit the angular displacement of the mount holding member between the mount loading position and the mount sealing position, the axis of said tubulation being in a generally vertical orientation in the mount loading position.

* * * * *